US009242488B2

(12) United States Patent
Samoto et al.

(10) Patent No.: US 9,242,488 B2
(45) Date of Patent: Jan. 26, 2016

(54) IMAGE RECORDING APPARATUS

(75) Inventors: Kenji Samoto, Nagoya (JP); Yuji Koga, Nagoya (JP)

(73) Assignee: Brother Kogyo Kabushiki Kaisha, Nagoya-shi, Aichi-Ken (JP)

( * ) Notice: Subject to any disclaimer, the term of this patent is extended or adjusted under 35 U.S.C. 154(b) by 371 days.

(21) Appl. No.: 13/072,192

(22) Filed: Mar. 25, 2011

(65) Prior Publication Data

US 2011/0310206 A1 Dec. 22, 2011

(30) Foreign Application Priority Data

Jun. 17, 2010 (JP) ..... 2010-137940

(51) Int. Cl.

| | |
|---|---|
| ***B41J 2/01*** | (2006.01) |
| ***B41J 29/13*** | (2006.01) |
| ***B41J 13/00*** | (2006.01) |
| ***B41J 29/02*** | (2006.01) |
| ***B41J 17/26*** | (2006.01) |
| *B41J 11/00* | (2006.01) |
| *B41J 25/308* | (2006.01) |

(52) U.S. Cl.

CPC ..... *B41J 13/0018* (2013.01); *B41J 17/26* (2013.01); *B41J 29/02* (2013.01); *B41J 11/007* (2013.01); *B41J 13/0009* (2013.01); *B41J 25/3088* (2013.01); *B41J 29/13* (2013.01)

(58) Field of Classification Search

USPC ..... 347/104, 101, 108; 346/145

See application file for complete search history.

(56) References Cited

U.S. PATENT DOCUMENTS

| | | | | |
|---|---|---|---|---|
| 6,736,389 | B2 * | 5/2004 | Kosmoski | 271/116 |
| 7,568,693 | B2 | 8/2009 | Izuchi et al. | |
| 7,614,738 | B2 * | 11/2009 | Takeuchi | 347/104 |
| 7,725,071 | B2 * | 5/2010 | Izuchi et al. | 399/401 |
| 7,959,147 | B2 * | 6/2011 | Izuchi et al. | 271/9.02 |
| 2007/0063429 | A1 | 3/2007 | Kang | |
| 2007/0071498 | A1 | 3/2007 | Ueda | |

(Continued)

FOREIGN PATENT DOCUMENTS

| | | | |
|---|---|---|---|
| CN | 1935522 | A | 3/2007 |
| CN | 101314287 | A | 12/2008 |

(Continued)

OTHER PUBLICATIONS

Japan Patent Office, Notification of Reason for Refusal for Japanese Patent Application No. 2010-137940 (counterpart to above-captioned patent application), dispatched Jun. 5, 2012.

(Continued)

*Primary Examiner* — Julian Huffman
*Assistant Examiner* — Leonard S Liang
(74) *Attorney, Agent, or Firm* — Baker Botts L.L.P.

(57) ABSTRACT

An image recording apparatus including: a first conveying path for guiding a recording medium in a conveying direction; a recording portion configured to record an image on the recording medium guided by the first conveying path; a tray provided below the recording portion so as to accommodate the recording medium; a supplying roller configured to supply the recording medium accommodated by the tray to the first conveying path; a first arm provided above the tray, wherein the supplying roller is provided on a distal end of the first arm; a first frame configured to support the recording portion; and a second frame provided separately from the first frame and configured to support the first arm.

15 Claims, 9 Drawing Sheets

(56) References Cited

U.S. PATENT DOCUMENTS

| | | | | |
|---|---|---|---|---|
| 2007/0146445 | A1* | 6/2007 | Nukui et al. | 347/85 |
| 2007/0176351 | A1* | 8/2007 | Izuchi et al. | 271/118 |
| 2007/0176962 | A1* | 8/2007 | Ogawa | 347/29 |
| 2007/0228642 | A1* | 10/2007 | Terada | 271/109 |
| 2008/0003038 | A1* | 1/2008 | Nihashi et al. | 400/188 |
| 2008/0157460 | A1* | 7/2008 | Izuchi et al. | 271/109 |
| 2008/0239047 | A1* | 10/2008 | Sugiyama et al. | 347/104 |
| 2008/0296836 | A1 | 12/2008 | Akiyama et al. | |
| 2009/0026685 | A1* | 1/2009 | Uchino et al. | 270/18 |
| 2009/0051720 | A1* | 2/2009 | Uchino et al. | 347/16 |
| 2009/0085949 | A1* | 4/2009 | Sugiyama et al. | 347/16 |
| 2009/0166963 | A1 | 7/2009 | Fukasawa | |
| 2009/0243209 | A1* | 10/2009 | Samoto | 271/273 |
| 2009/0250867 | A1* | 10/2009 | Samoto | 271/117 |
| 2009/0322844 | A1* | 12/2009 | Komuro et al. | 347/104 |
| 2010/0001461 | A1* | 1/2010 | Takeshita | 271/274 |
| 2010/0059926 | A1* | 3/2010 | Terada | 271/10.09 |
| 2010/0078872 | A1* | 4/2010 | Asada et al. | 271/10.12 |
| 2010/0238475 | A1* | 9/2010 | Mizutani | 358/1.12 |
| 2011/0057382 | A1* | 3/2011 | Shinozaki et al. | 271/110 |
| 2011/0187040 | A1* | 8/2011 | Tanahashi et al. | 271/3.18 |
| 2011/0188916 | A1* | 8/2011 | Sano et al. | 400/642 |
| 2012/0133718 | A1* | 5/2012 | Sakano | 347/104 |

FOREIGN PATENT DOCUMENTS

| | | | |
|---|---|---|---|
| CN | 101468558 | A | 7/2009 |
| JP | H04-031150 | U | 3/1992 |
| JP | 2000-327148 | A | 11/2000 |
| JP | 2002-356245 | A | 12/2002 |
| JP | 2003-122072 | A | 4/2003 |
| JP | 2007-090592 | A | 4/2007 |
| JP | 2009-242079 | A | 10/2009 |

OTHER PUBLICATIONS

Japan Patent Office, Decision to Grant a Patent for Japanese Patent Application No. 2010-137940 (counterpart Japanese patent application), dispatched Mar. 5, 2013.

State Intellectual Property Office of the People'S Republic of China, Notification of First Office Action for Chinese Patent Application No. 201110070356.9 (counterpart to above-captioned patent application), mailed Jul. 29, 2013.

The State Intellectual Property Office of the People'S Republic of China, Notification of the Second Office Action for Chinese Patent Application No. 201110070356.9 (counterpart to above-captioned patent application), mailed Mar. 13, 2014.

* cited by examiner

IMAGE RECORDING APPARATUS

CROSS REFERENCE TO RELATED APPLICATION

The present application claims priority from Japanese Patent Application No. 2010-137940, which was filed on Jun. 17, 2010, the disclosure of which is herein incorporated by reference in its entirety.

BACKGROUND OF THE INVENTION

1. Field of the Invention

The present invention relates to an image recording apparatus configured to convey a recording medium through a convey path and record an image on the recording medium.

2. Description of the Related Art

There is conventionally known an image recording apparatus including a sheet-supply portion configured to pick up a recording sheet accommodated in a tray and supply the recording sheet to a convey path. For example, the sheet-supply portion includes a sheet-supply roller, an arm, and a shaft. The sheet-supply roller is rotatably provided on a distal end portion of the arm. The shaft is provided on a basal end portion of the arm, and the arm is pivotable about the shaft. The arm is urged by its own weight or an elastic force of, e.g., a spring so as to be pivoted toward a tray. Where the sheet-supply roller is rotated in a state in which the sheet-supply roller is held in pressing contact with an uppermost one of the recording sheets on the tray, the recording sheet is supplied into the convey path by a frictional force between a roller face of the sheet-supply roller and the recording sheet.

Here, the shaft provided on the basal portion of the arm is normally mounted on a frame of the image recording apparatus. For example, there is a multi-function device (MFD) configured such that a sheet-supply roller is rotatably supported on a distal end of an arm, the arm is provided pivotably about a shaft, and the shaft is supported by an upper unit as a frame of the MFD.

SUMMARY OF THE INVENTION

In addition to the above-described shaft, the frame supports (a) a recording portion provided in the image recording apparatus, (b) a platen for supporting the recording sheet conveyed through a position just under the recording portion, and so on. Here, where the recording portion is of an ink-jet type, the recording portion is constituted by recording heads and a carriage holding the heads, for example. Where the recording portion is of an electronic-photography type, the recording portion is constituted by a drum unit and so on, for example.

However, where the recording portion, the platen, and so on, and the sheet-supply arm are supported by the same frame, the following problem may arise. Where a sheet-supply operation for supplying the recording sheet has been performed by the sheet-supply portion while the recording portion records the image on the recording sheet supported by the platen, a load of the sheet-supply arm is imposed on the frame in an upward and downward direction. This may cause a curl or a distortion of the frame, which may cause a curl or a distortion of the recording portion and the platen supported by the frame. Where these curls and/or distortions have been caused, a gap or a distance between the recording portion and the recording sheet supported by the platen is changed, leading to a deterioration of a quality of the image recorded on the recording sheet.

This invention has been developed in view of the above-described situations, and it is an object of the present invention to provide a structure configured to reduce an effect of a medium-supply operation on image recording, thereby reducing a deterioration of a quality of an image recorded on a recording medium.

The object indicated above may be achieved according to the present invention which provides an image recording apparatus comprising: a first conveying path for guiding a recording medium in a conveying direction; a recording portion configured to record an image on the recording medium guided by the first conveying path; a tray provided below the recording portion so as to accommodate the recording medium; a supplying roller configured to supply the recording medium accommodated by the tray to the first conveying path; a first arm provided above the tray, wherein the supplying roller is provided on a distal end of the first arm; a first frame configured to support the recording portion; and a second frame provided separately from the first frame and configured to support the first arm.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which.

DETAILED DESCRIPTION OF THE EMBODIMENT

Figure 1:
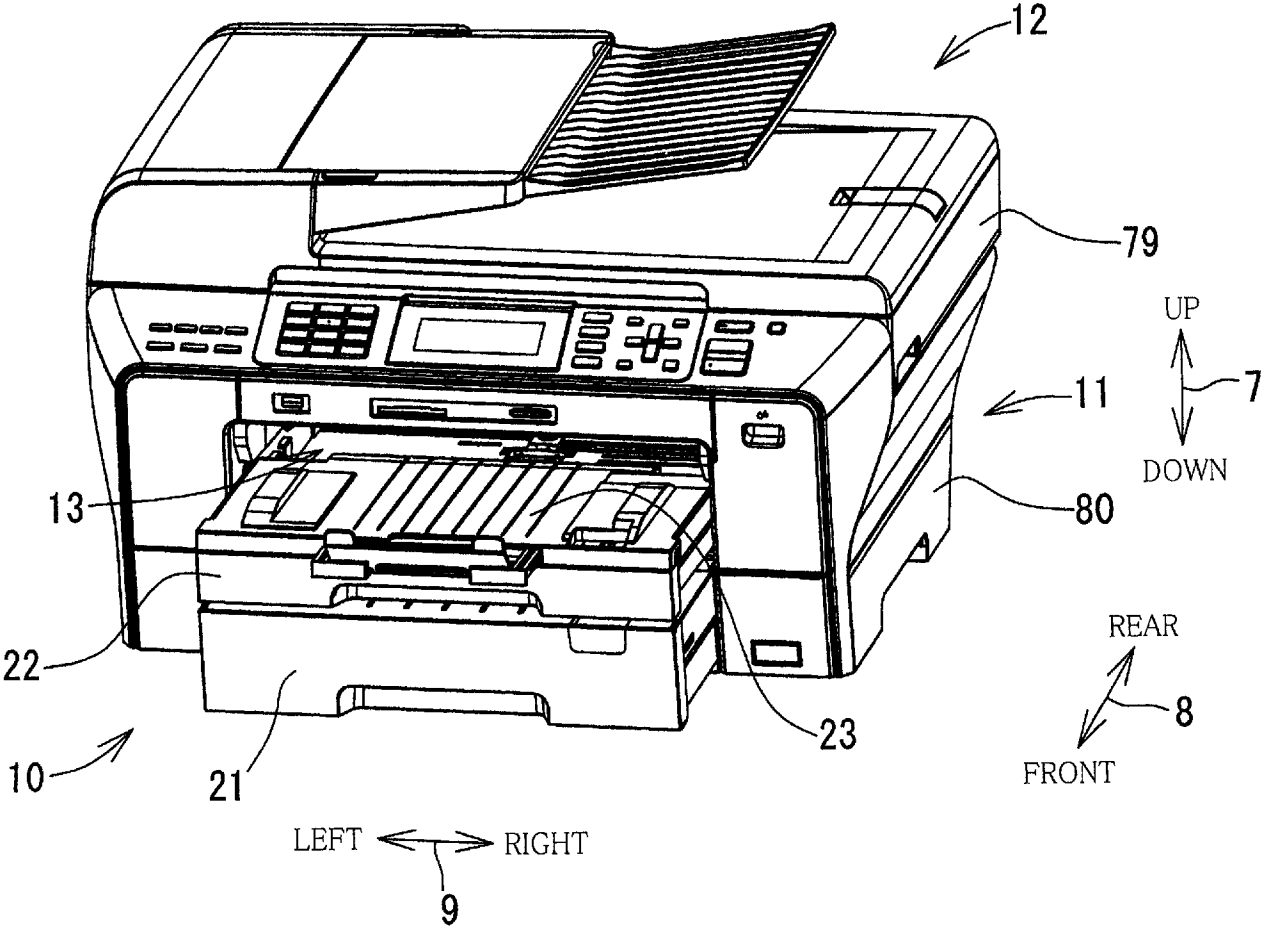
FIG. 1 is a perspective view of a multi-function device (MFD) 10.

Hereinafter, there will be described an embodiment of the present invention by reference to the drawings. It is to be understood that the following embodiment is described only by way of example, and the invention may be otherwise embodied with various modifications without departing from the scope and spirit of the invention. In this embodiment, an upward and downward direction 7 is defined as a top and bottom direction of a multi-function device (MFD) 10 set in a usable state (shown in FIG. 1). A frontward and rearward direction 8 is defined in a state in which a side of the MFD 10 on which an opening 13 is formed is a front side. A rightward and leftward direction 9 is defined in a state in which the MFD 10 is viewed from the front side. As directions of sheet-supply trays 21, 22, the upward and downward direction 7, the frontward and rearward direction 8, and the rightward and leftward direction 9 are defined in a state in which the trays 21, 22 are mounted on the MFD 10 (shown in FIG. 1).

<General Construction of Multi-Function Device 10>

The MFD 10 is an example of an image recording apparatus to which the present invention is applied. As shown in FIG. 1, the MFD 10 has a generally rectangular parallelepiped shape. A scanning section 12 is provided in an upper portion of the MFD 10. A printing section 11 of an ink-jet recording type is provided in a lower portion of the MFD 10. The MFD 10 has various functions such as a facsimile function and a printing function. It is noted that functions other than the printing function are optional and accordingly may be omitted.

The printing section 11 includes a casing 80 having the opening 13 on its front side. The sheet-supply trays 21, 22 can be inserted or removed through the opening 13 in the frontward and rearward direction 8. A plurality of recording media in the form of recording sheets 50 of various sizes can be stacked on the sheet-supply trays 21, 22. It is noted that a casing 79 of the scanning section 12 is provided on an upper side of the casing 80.

Figure 2:
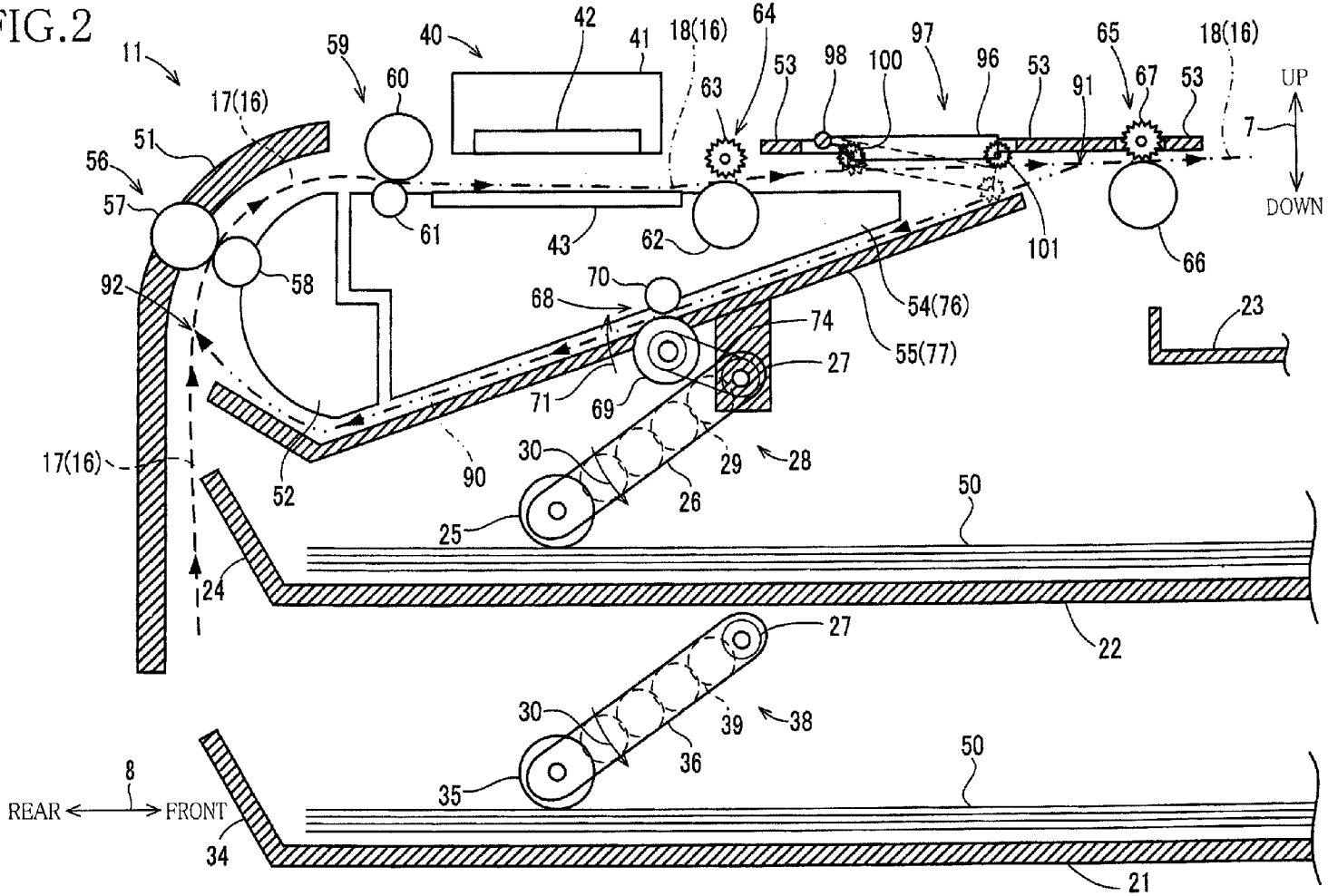
FIG. 2 is an elevational view in vertical cross section schematically showing an internal structure of a printing section 11.

As shown in FIG. 2, the sheet-supply trays 21, 22 are disposed below a recording portion 40 which will be described below. In the printing section 11, each recording sheet 50 is selectively supplied from the sheet-supply tray 21 or the sheet-supply tray 22 into the printing section 11. The supplied recording sheet 50 is conveyed or fed in a conveying direction through a first sheet-convey path 16 which will be described below. After an image has been recorded on the conveyed recording sheet 50 by the recording portion 40, the recording sheet 50 is discharged onto a sheet-discharge tray 23 provided on an upper face of the sheet-supply tray 22. Here, the conveying direction is a direction indicated by broken-line arrow and one-dot chain-line arrow shown in FIG. 2.

As shown in FIGS. 1 and 2, the sheet-supply trays 21, 22 are disposed so as to have a two-tier structure in a vertical direction in which the sheet-supply tray 22 is located on an upper face of the sheet-supply tray 21. Providing the two sheet-supply trays 21, 22 permits the recording sheets 50 having different sizes or types to be accommodated in the two sheet-supply trays 21, 22.

<First Sheet-Convey Path 16>

As shown in FIG. 2, the first sheet-convey path 16 is defined in the printing section 11 in order to guide the recording sheet 50. The first sheet-convey path 16 extends from a position just above an inclined plate 34 of the sheet-supply tray 21 or an inclined plate 24 of the sheet-supply tray 22 to the sheet-discharge tray 23 via the recording portion 40. The first sheet-convey path 16 is constituted by a curved path 17 indicated by a broken line in FIG. 2 and a sheet-discharge path 18 indicated by a one-dot chain line in FIG. 2. The curved path 17 curves and extends from the position just above the inclined plate 34 or 24 to a convey-roller pair 59 which will be described below. The sheet-discharge path 18 continues to the curved path 17 and extends in a generally straight manner from the convey-roller pair 59 to the sheet-discharge tray 23 via a position just under the recording portion 40.

The curved path 17 is defined by an outer guide member 51 and an inner guide member 52 with a specific distance interposed therebetween. The sheet-discharge path 18 is defined by the recording portion 40, an upper guide member 53, and a first frame main body 54. The upper guide member 53 is provided on a downstream side of the recording portion 40 in the conveying direction. The first frame main body 54 faces the recording portion 40 and the upper guide member 53 with a specific distance interposed therebetween. It is noted that each of the outer guide member 51, the inner guide member 52, the upper guide member 53, the first frame main body 54, and a lower guide member 55 which will be described below extends in a direction perpendicular to a sheet face of FIG. 2, i.e., the rightward and leftward direction 9 in FIG. 1.

<Supply Portions 28, 38>

When the sheet-supply tray 22 has been completely mounted in the printing section 11, the inclined plate 24 is located under the first sheet-convey path 16, and the sheet-supply tray 22 is located under a first supply portion 28. The first supply portion 28 includes a sheet-supply roller 25, a first arm such as a sheet-supply arm 26, and a shaft 27. The sheet-supply roller 25 is rotatably provided on a distal end portion of the sheet-supply arm 26. This sheet-supply roller 25 is rotated by a drive power transmitted via a drive-power transmitting mechanism 29 from an ASF (Auto Sheet Feed) motor, not shown, as a drive source different from a sheet-convey motor 102 (see FIGS. 3 and 5). The drive-power transmitting mechanism 29 is supported by the sheet-supply arm 26 and constituted by a plurality of gears arranged in a generally straight manner. Opposite end portions of the shaft 27 are rotatably supported by a second right plate 83 and a second left plate 84 which will be explained below.

The sheet-supply arm 26 is supported at a basal end portion thereof by the shaft 27 so as to be pivotable about the shaft 27. The sheet-supply arm 26 is thus movable upward and downward so as to be moved toward and away from the sheet-supply tray 22. Further, the sheet-supply arm 26 is urged by its own weight or an elastic force of an elastic member such as a spring so as to be pivoted in a direction indicated by an arrow 30 in FIG. 2. This allows the sheet-supply roller 25 to be brought into pressing contact with an upper face of an uppermost one of the recording sheets 50 accommodated in the sheet-supply tray 22. That is, the sheet-supply arm 26 can be pivoted to take a first posture in which the sheet-supply roller 25 can be brought into contact with a sheet-placed face of the sheet-supply tray 22 on which the recording sheets 50 are placed or stacked, that is, a distal end portion of the sheet-supply arm 26 contacts the sheet-placed face.

Further, when the sheet-supply tray 22 is inserted into the printing section 11 or when the sheet-supply tray 22 is pulled to be removed from the printing section 11, the sheet-supply arm 26 is pressed by the upper face of the sheet-supply tray 22 (e.g., the inclined plate 24) so as to be pivoted upward. As a result, the sheet-supply arm 26 can be pivoted to take a second posture in which the distal end portion of the sheet-supply arm 26 is distant from the sheet-placed face.

The sheet-supply arm 26 is urged by its own weight or the elastic force of, e.g., the spring so as to be pivoted toward the sheet-supply tray 22. The first supply portion 28 picks up the recording sheet 50 from the sheet-supply tray 22 to supply the sheet 50 to the curved path 17. A second supply portion 38 has the same construction as the first supply portion 28. That is, the second supply portion 38 includes a sheet-supply roller 35, a sheet-supply arm 36, a shaft 37, and a drive-power transmitting mechanism 39 and picks up the recording sheet 50 from the sheet-supply tray 21 to supply the sheet 50 to the curved path 17.

<Convey-Roller Pair 59>

As shown in FIG. 2, in the first sheet-convey path 16 is provided the convey-roller pair 59 as an example of a first roller pair which is located on an upstream side of the recording portion 40 in the conveying direction. The convey-roller pair 59 is constituted by a convey roller 60 and a pinch roller 61. The convey roller 60 is disposed at an upper portion of the first sheet-convey path 16 and rotated by a drive power of the sheet-convey motor 102. The pinch roller 61 is rotatably disposed so as to face the convey roller 60 with the first sheet-convey path 16 interposed therebetween, that is, the pinch roller 61 is rotatably disposed at a lower portion of the first sheet-convey path 16. The pinch roller 61 is urged toward the convey roller 60 by a spring, for example. As a result, the convey-roller pair 59 nips and conveys the sheet 50 toward the recording portion 40 through the first sheet-convey path 16, i.e., in the conveying direction.

<Discharge-Roller Pair 64>

As shown in FIG. 2, in the first sheet-convey path 16 (the sheet-discharge path 18) is provided a discharge-roller pair 64 as an example of a second roller pair which is located on a downstream side of the recording portion 40 in the conveying direction. The discharge-roller pair 64 is constituted by a sheet-discharge roller 62 and a spur roller 63. The sheet-discharge roller 62 is disposed at the lower portion of the sheet-discharge path 18 and rotated by the drive power of the sheet-convey motor 102. The spur roller 63 is rotatably disposed on an upper side of the sheet-discharge roller 62 with the sheet-discharge path 18 interposed therebetween. The spur roller 63 is urged toward the sheet-discharge roller 62 by a spring, for example. As a result, the discharge-roller pair 64 nips and conveys the sheet 50 toward the sheet-discharge tray 23 through the sheet-discharge path 18, i.e., toward a downstream side in the conveying direction.

<Midway-Roller Pair 56>

As shown in FIG. 2, in the first sheet-convey path 16 (the curved path 17) is provided a midway-roller pair 56 which is located on an upstream side of the convey-roller pair 59 in the conveying direction. The midway-roller pair 56 is constituted by a first midway roller 57 and a second midway roller 58. The first midway roller 57 is disposed at an outer portion of the curved path 17 and rotated by a drive power of the sheet-convey motor 102. The second midway roller 58 is rotatably disposed so as to face the first midway roller 57 with the curved path 17 interposed therebetween. The second midway roller 58 is urged toward the first midway roller 57 by a spring, for example. As a result, the midway-roller pair 56 nips and conveys the sheet 50 toward the convey-roller pair 59 through the curved path 17.

It is noted that the drive power of the sheet-convey motor 102 is transmitted to rollers such as the convey roller 60 via an intermediate gear, not shown, and a belt, not shown.

<Recording Portion 40>

As shown in FIG. 2, the recording portion 40 includes recording heads 42 and a carriage 41 on which the recording heads 42 are mounted and which is reciprocated in a main scanning direction that coincides with the direction perpendicular to the sheet face of FIG. 2. Inks of respective four colors, namely, cyan (C), magenta (M), yellow (Y), and black (Bk) are respectively supplied to the recording heads 42 from ink cartridges, not shown. Each recording head 42 ejects the ink as fine ink droplets from nozzles formed in a lower face thereof. The carriage 41 is reciprocated in the main scanning direction, whereby the recording heads 42 are accordingly reciprocated relative to the recording sheet 50. The recording heads 42 eject the respective inks while being reciprocated to record an image on the recording sheet 50 being conveyed on a support member such as a platen 43 through the sheet-discharge path 18. The platen 43 is provided under the recording portion 40 so as to face the recording portion 40 in order to support the recording sheet 50 being conveyed at the position just under the recording portion 40 along the sheet-discharge path 18. The platen 43 is supported by the first frame main body 54.

After the recording sheet 50 is supplied to the curved path 17 from the sheet-supply tray 22 by the first supply portion 28 or from the sheet-supply tray 21 by the second supply portion 38, the sheet 50 is guided by the convey-roller pair 59 to the recording portion 40 at which the image is recorded by the recording heads 42. The sheet 50 is then discharged onto the sheet-discharge tray 23 by the discharge-roller pair 64.

<Path Switch Portion 97 and Reverse-Roller Pair 65>

As shown in FIG. 2, a path switch portion 97 and a reverse-roller pair 65 as an example of a third roller pair are provided for guiding, to a second sheet-convey path 90 which will be described below, the recording sheet 50 located downstream of the discharge-roller pair 64 in the conveying direction in the sheet-discharge path 18. The path switch portion 97 is provided on a downstream side of the discharge-roller pair 64 in the conveying direction. The reverse-roller pair 65 is provided on a downstream side of the path switch portion 97 in the conveying direction.

The reverse-roller pair 65 is constituted by a drive roller 66 and spur rollers 67. The drive roller 66 is disposed at the lower portion of the first sheet-convey path 16 (the sheet-discharge path 18) and rotated by the drive power of the sheet-convey motor 102. The spur rollers 67 are rotatably disposed on an upper side of the drive roller 66 with the first sheet-convey path 16 interposed therebetween. The spur rollers 67 are urged toward the drive roller 66 by a spring, for example. This allows the reverse-roller pair 65 to nip the recording sheet 50. The drive roller 66 is rotatable forwardly and reversely. When rotated forwardly, the drive roller 66 conveys the recording sheet 50 in the conveying direction. When rotated reversely, the drive roller 66 conveys the recording sheet 50 in a direction opposite to the conveying direction.

The path switch portion 97 includes a flap 96, a shaft 98, and sub-rollers 100, 101. The flap 96 is pivotable about the shaft 98 between (a) a sheet-discharge posture as an example of a third posture indicated by a solid line in FIG. 2 and (b) a sheet-reverse posture as an example of a fourth posture indicated by a broken line in FIG. 2. The sheet-discharge posture is a posture for conveying the recording sheet 50 having passed through the recording portion 40 to the downstream side through the first sheet-convey path 16 and discharging the sheet 50 onto the sheet-discharge tray 23. The sheet-reverse posture is a posture for guiding the recording sheet 50 to the second sheet-convey path 90. The sub-rollers 100, 101 each as a spur roller are rotatably mounted on a lower face of the flap 96. Opposite end portions of the shaft 98 are rotatably supported by the second right plate 83 and the second left plate 84 which will be explained below.

The path switch portion 97 is normally kept in the sheet-reverse posture by being pivoted downward by its own weight. When a leading end of the recording sheet 50 having passed through the position just under the recording portion 40 has reached the path switch portion 97 in the state which the path switch portion 97 is in the sheet-reverse posture, the path switch portion 97 is pressed by the upper face of the recording sheet 50, which changes the posture of the path switch portion 97 from the sheet-reverse posture to the sheet-discharge posture. In this state, the recording sheet 50 continued to be conveyed is nipped by the reverse-roller pair 65 provided downstream of the path switch portion 97 in the conveying direction. Since the drive roller 66 is being forwardly rotated in the state in which the path switch portion 97 is kept in the sheet-discharge posture, the recording sheet 50 is conveyed toward the sheet-discharge tray 23. When a trailing end portion of the recording sheet 50 has reached a predetermined position located on an upstream side of the sub-roller 101, a force of the path switch portion 97 for pivoting the path switch portion 97 toward a sheet-reverse posture side by its own weight becomes larger than a force of the recording sheet 50 for pressing the path switch portion 97 upward. Accordingly, the posture of the path switch portion 97 is changed from the sheet-discharge posture to the sheet-reverse posture. As a result, the trailing end portion of the recording sheet 50 is pressed by the sub-roller 101 downward so as to be directed toward the second sheet-convey path 90 or a sheet-reverse path 90.

In a case of one-side recording, the drive roller 66 continues to be rotated forwardly. As a result, the recording sheet 50 is discharged onto the sheet-discharge tray 23. On the other hand, in a case of two-side recording, the rotation of the drive roller 66 is changed from the forward rotation to the reverse rotation in the state in which the trailing end portion of the recording sheet 50 is directed to the second sheet-convey path 90. As a result, the recording sheet 50 is switched back or conveyed into the second sheet-convey path 90.

<Second Sheet-Convey Path 90>

As shown in FIG. 2, the second sheet-convey path 90 is provided in the printing section 11. The second sheet-convey path 90 guides the recording sheet 50 from a downstream side of the recording portion 40 in the conveying direction in the first sheet-convey path 16, to an upstream side of the convey-roller pair 59 in the conveying direction in the first sheet-convey path 16. The second sheet-convey path 90 is branched at a branch opening 91 from the first sheet-convey path 16 (the sheet-discharge path 18) and extends so as to pass through a position below the recording portion 40 and above the sheet-supply tray 22 and then merges with the first sheet-convey path 16 (the curved path 17) at a meeting point 92. The recording sheet 50 is conveyed through the second sheet-convey path 90 in a sheet-resupply direction indicated by a two-dot chain-line arrow in FIG. 2. The recording sheet 50 on which the image is recorded on a front face thereof by the recording portion 40 is flipped or turned upside down by passing through the second sheet-convey path 90 and supplied to the recording portion 40 again. Then, an image is recorded on a back face of the recording sheet 50 by the recording portion 40 in the same manner as the image is recorded on the front face.

The second sheet-convey path 90 is defined by the above-described first frame main body 54 and the lower guide member 55 provided under the first frame main body 54 so as to face the first frame main body 54 with a specific distance interposed therebetween.

<Reconvey-Roller Pair 68 and Sheet-Convey Arm 74>

In the second sheet-convey path 90 is provided a reconvey-roller pair 68 which is constituted by a reconvey or resupply roller 69 and a pinch roller 70 as an example of a nip member. The pinch roller 70 is disposed at an upper portion of the second sheet-convey path 90 so as to be pressed by the reconvey roller 69 as will be described below. The reconvey roller 69 is disposed at the lower portion of the second sheet-convey path 90 so as to face the pinch roller 70 with the second sheet-convey path 90 interposed therebetween. The reconvey roller 69 is rotated by the drive power of the sheet-convey motor 102. The rotation of the reconvey roller 69 causes the reconvey-roller pair 68 to nip and convey the recording sheet 50 conveyed from the branch opening 91 to the second sheet-convey path 90, to the meeting point 92, i.e., to the first sheet-convey path 16.

A second arm such as sheet-convey arm 74 is provided under the lower guide member 55. The sheet-convey arm 74 is supported at its basal end portion (i.e., its front end portion) by the shaft 27 so as to be pivotable about the shaft 27. The reconvey roller 69 is rotatably supported by a shaft at a distal end portion (i.e., a rear end portion) of the sheet-convey arm 74. A coil spring, not shown, is mounted on the sheet-convey arm 74. The sheet-convey arm 74 is urged by an elastic force of the coil spring so as to be pivoted in a direction indicated by an arrow 71. As a result, the reconvey roller 69 is held in pressing contact with the pinch roller 70. In the present embodiment, the sheet-convey arm 74 and the sheet-supply arm 26 are pivotable about the same pivotal shaft, i.e., the shaft 27. It is noted that the sheet-convey arm 74 and the sheet-supply arm 26 may be pivoted by different pivotal shafts.

<First Frame 76>

Figure 3:
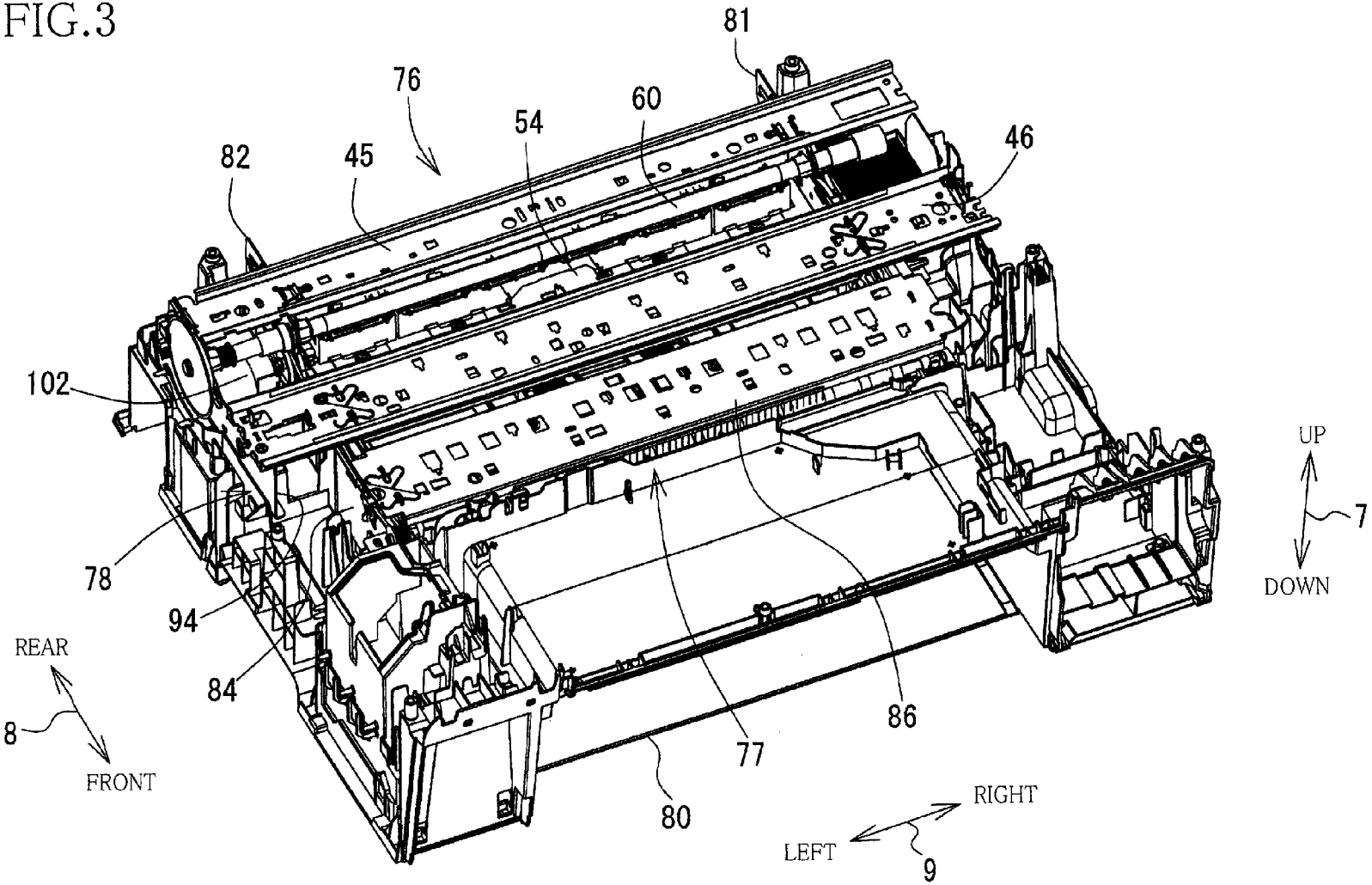
FIG. 3 is a perspective view of frames 76-78 and a casing 80.
Figure 4:
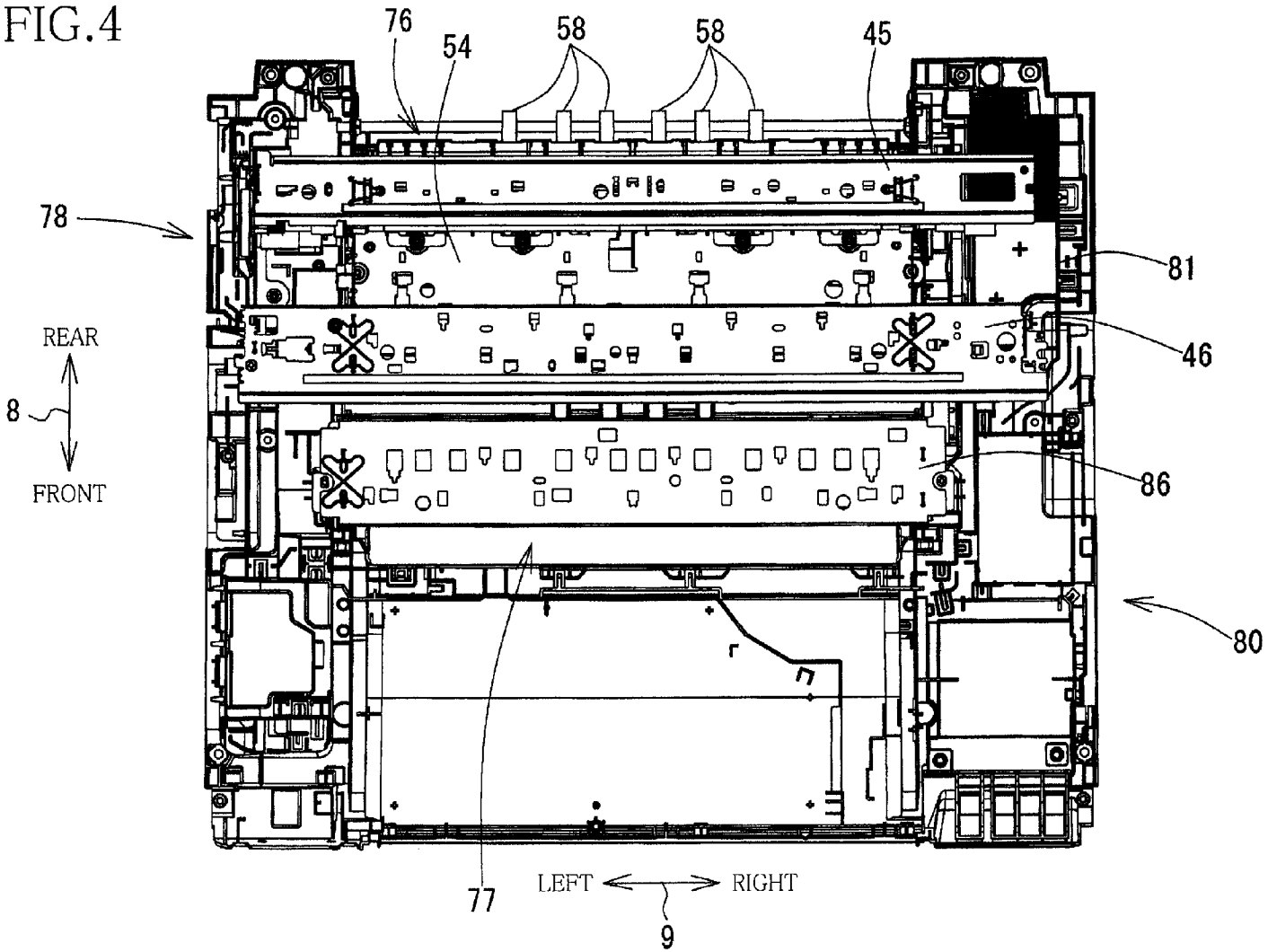
FIG. 4 is a plan view of the frames 76-78 and the casing 80.

As shown in FIGS. 3 and 4, the printing section 11 includes three metal frames, namely, a first frame 76, a the second frame 77, and a third frame 78. Each of the frames 76, 77, 78 is mounted on an upper portion of the casing 80 of the printing section 11. That is, each frame 76, 77, 78 is supported by the casing 80.

Figure 5:
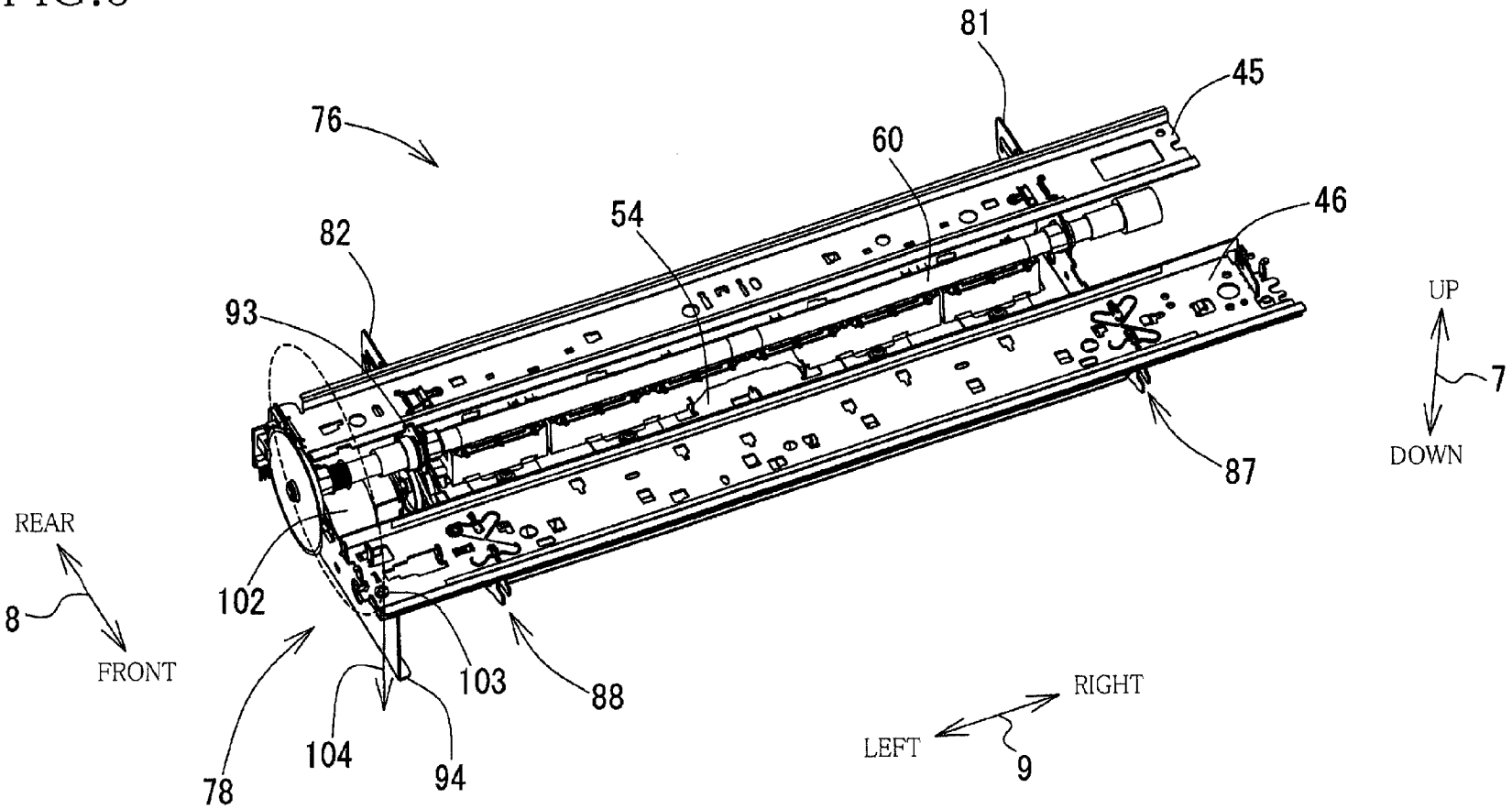
FIG. 5 is a perspective view of the first frame 76 and the third frame 78.

As shown in FIG. 5, the first frame 76 is constituted by the first frame main body 54 as an example of a bottom plate, a pair of side plates (i.e., a first right plate 81 and a first left plate 82), and guide rails 45, 46.

The first frame main body 54 is formed by a generally flat rectangular plate expanding in the frontward and rearward direction 8 and the rightward and leftward direction 9. The platen 43 is supported by an upper face of the first frame main body 54. The first right plate 81 is provided upright on a right end of the upper face of the first frame main body 54 in the rightward and leftward direction 9. The first left plate 82 is provided upright on a left end of the upper face of the first frame main body 54 in the rightward and leftward direction 9. It is noted that opposite end portions of the first frame main body 54 in the frontward and rearward direction 8 are bent in order for the first frame main body 54 not to be easily warped.

Each of the first right plate 81 and the first left plate 82 is formed by a generally flat rectangular plate expanding in the upward and downward direction 7 and the frontward and rearward direction 8. That is, each of the first right plate 81 and the first left plate 82 is provided upright so as to expand in the frontward and rearward direction 8 (i.e., in the conveying direction). Further, a distance in the rightward and leftward direction 9 between the first right plate 81 and a center of the recording sheet 50 conveyed through the sheet-discharge path 18 in a widthwise direction of the recording sheet 50 (i.e., in the rightward and leftward direction 9) is the same as a distance in the rightward and leftward direction 9 between the first left plate 82 and the center of the recording sheet 50. That is, the first right plate 81 and the first left plate 82 are mounted on the first frame main body 54 so as to be symmetric in the rightward and leftward direction 9 with respect to the center of the recording sheet 50.

The guide rails 45, 46 are mounted on respective upper faces of the first right plate 81 and the first left plate 82. Each of the guide rails 45, 46 has a flat plate shape extending in a widthwise direction of the sheet-discharge path 18, i.e., in the rightward and leftward direction 9. The guide rails 45, 46 are disposed so as to be distant from each other in the conveying direction at a specific distance therebetween. As described above, the recording heads 42 are held on the carriage 41. Further, the carriage 41 is supported on the guide rails 45, 46 so as to be slidable in the widthwise direction of the sheet-discharge path 18, i.e., in the rightward and leftward direction 9. That is, the first frame 76 supports the recording portion 40.

Opposite end portions of each of the convey-roller pair 59, the discharge-roller pair 64, and the pinch roller 70 in their respective axial directions (i.e., in the rightward and leftward direction 9) are rotatably supported by the first right plate 81 and the first left plate 82.

<Second Frame 77>

Figure 6:
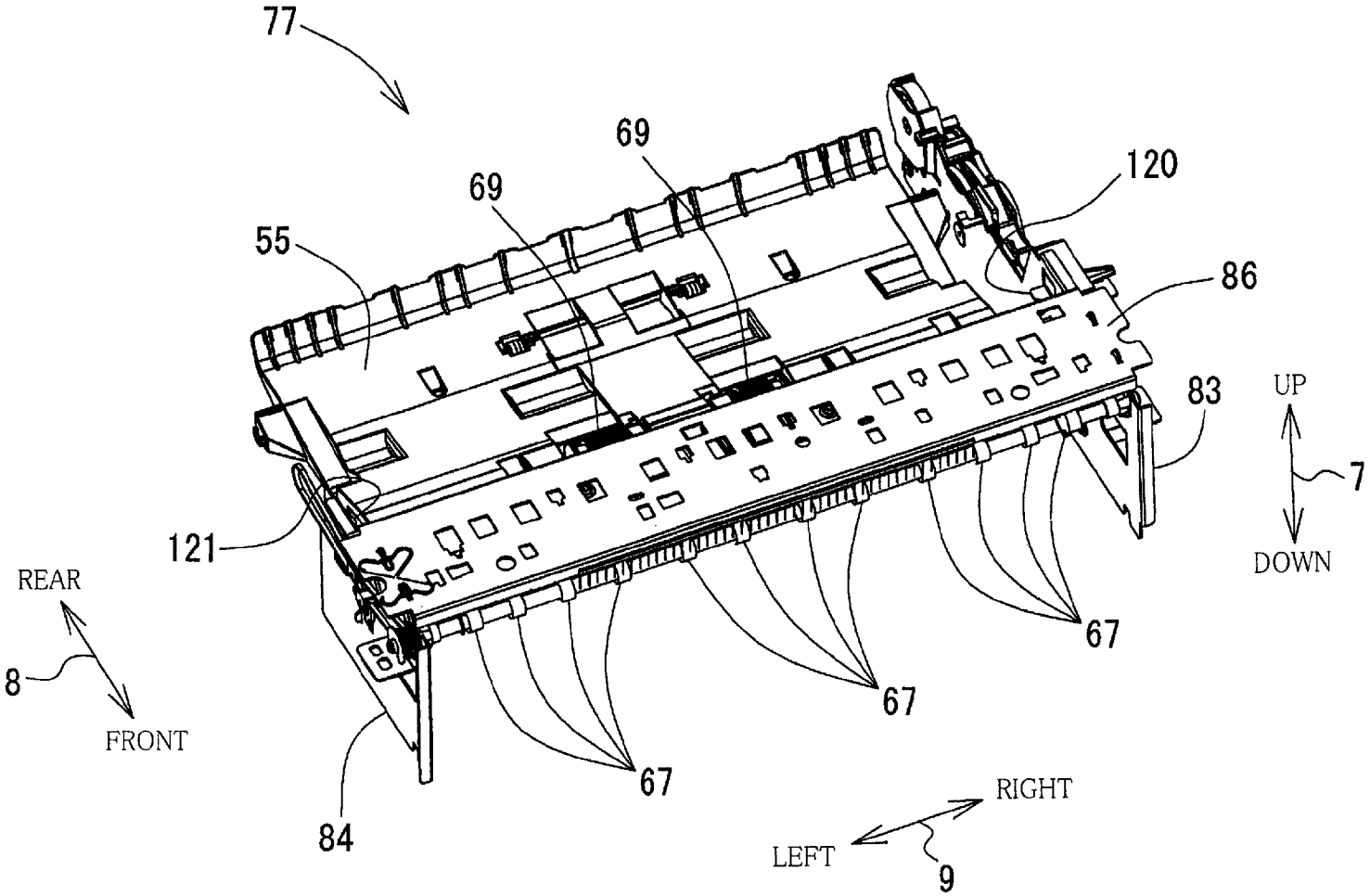
FIG. 6 is a perspective view of the second frame 77.

As shown in FIG. 6, the second frame 77 is constituted by an upper plate 86, the lower guide member 55, and the pair of side plates (the second right plate 83 and the second left plate 84).

The upper plate 86 is formed by a generally rectangular flat plate expanding in the frontward and rearward direction 8 and the rightward and leftward direction 9. The upper guide member 53 is mounted on a lower face of the upper plate 86. The lower face of the upper plate 86 is fixed at its right end to a front end of an upper face of the second right plate 83. Further, the lower face of the upper plate 86 is fixed at its left end to an upper face of the second left plate 84.

Each of the second right plate 83 and the second left plate 84 is formed by a generally rectangular flat plate expanding in the upward and downward direction 7 and the frontward and rearward direction 8. The second right plate 83 is longer than the second left plate 84 in the frontward and rearward direction 8. Opposite end portions of each of the shaft 27 of the sheet-supply arm 26, the sheet-convey arm 74, the reverse-roller pair 65, and the shaft 98 of the path switch portion 97 in their respective axial directions (i.e., in the rightward and leftward direction 9) are rotatably supported by the second right plate 83 and the second left plate 84. It is noted that the sheet-supply arm 36 may or may not be supported by the second right plate 83 and the second left plate 84, i.e., the second frame 77. However, even where the sheet-supply arm 36 is not supported by the second frame 77, the sheet-supply arm 36 is not supported by the first frame 76 and is supported by a frame other than the first frame 76 or the second frame 77.

The lower guide member 55 is formed by a generally rectangular flat plate expanding in the frontward and rearward direction 8 and the rightward and leftward direction 9. Below the upper guide member 53, a front end portion of the lower guide member 55 is mounted at its right end on a left side face of the second right plate 83 and mounted at its left end on a right side face of the second left plate 84. An upper face of the lower guide member 55 (i.e., a sheet-convey face for conveying the recording sheet 50 through the second sheet-convey path 90) is inclined downward from the front end portion thereof toward a rear side thereof.

As shown in FIG. 5, a recessed portion 87 is formed in a front end portion of the first right plate 81 of the first frame 76, and a recessed portion 88 is formed in a front end portion of the first left plate 82 of the first frame 76. The recessed portions 87, 88 are recessed rearward, that is, opened frontward. Projecting portions 120, 121 of the second frame 77 which will be described below are respectively inserted into the recessed portion 87, 88. A width of each recessed portion 87, 88 in the upward and downward direction 7 is larger than that of each projecting portion 120, 121 in the upward and downward direction 7. Further, as shown in FIG. 6, the projecting portion 120 is provided on the left side face of the second right plate 83 so as to project leftward. Specifically, the projecting portion 120 is located at a generally central position of the left side face in the frontward and rearward direction 8 and near an upper end thereof in the upward and downward direction 7. The projecting portion 121 is provided on the right side face of the second left plate 84 so as to project rightward from a position corresponding to the projecting portion 120. Each of the projecting portions 120, 121 is formed by a plate expanding in the frontward and rearward direction 8 and the rightward and leftward direction 9 and having a relatively small thickness in the upward and downward direction 7. It is noted that, instead of the above-described construction, this MFD 10 may be configured such that the projecting portions are formed on the first frame 76, and the recessed portions are formed in the second frame 77.

When the second frame 77 is supported at its lower portion by the casing 80, the projecting portion 120 is fitted into the recessed portion 87 of the first frame 76 such that a rear end of the projecting portion 120 is brought into rearward pressing contact with the recessed portion 87, and the projecting portion 121 is fitted into the recessed portion 88 of the first frame 76 such that a rear end of the projecting portion 121 is brought into rearward pressing contact with the recessed portion 88. That is, the first frame 76 is not directly connected to the second frame 77 (in other words, the first frame 76 is provided separately from the second frame 77) but is held in contact with the second frame 77 at a downstream portion of the first frame 76 in the conveying direction.

Since the second frame 77 is pressed rearward onto the first frame 76, the second frame 77 is positioned relative to the first frame 76 in the frontward and rearward direction 8. However, the width of each projecting portion 120, 121 in the upward and downward direction 7 is smaller than the width of each recessed portion 87, 88 in the upward and downward direction 7. Accordingly, each of the projecting portions 120, 121 is movable in the upward and downward direction 7 in a state in which each projecting portion 120, 121 is held in contact with a corresponding one of the recessed portions 87, 88. That is, the second frame 77 is not positioned relative to the first frame 76 in the upward and downward direction 7.

<Third Frame 78>

As shown in FIG. 5, the third frame 78 is provided on a left side of the first left plate 82 of the first frame 76. The third frame 78 is constituted by (a) a bottom plate, not shown, located under the sheet-convey motor 102, (b) a third right plate 93 located on a right side of the motor 102, and (c) a third left plate 94 located on a left side of the motor 102 such that right, left, and lower faces of the sheet-convey motor 102 are enclosed. Opposite end portions of a shaft, not shown, of the sheet-convey motor 102 in its axial direction (i.e., the rightward and leftward direction 9) are rotatably supported respectively by the third right plate 93 and the third left plate 94. Further, respective upper end portions of the third right plate 93 and the third left plate 94 support the convey roller 60 such that the roller 60 is rotatable.

Further, the third frame 78 is connected or tightened to the first frame 76 along a tangential direction 104 of a concentric circle (indicated by a broken line in FIG. 5) centered about a rotational shaft of the convey roller 60. For example, a screw 103 used to tighten or connect the third frame 78 to the guide rail 46 of the first frame 76 is tightened to the guide rail 46 in the tangential direction 104 of the concentric circle centered about the rotational shaft of the convey roller 60.

It is noted that the third frame 78 may be provided on a right side of the first right plate 81 of the first frame 76. Further, the third frame 78 may be provided on each of outsides of the first left plate 82 and the first right plate 81.

<Support for First Frame 76 by Casing 80>

Figure 7:
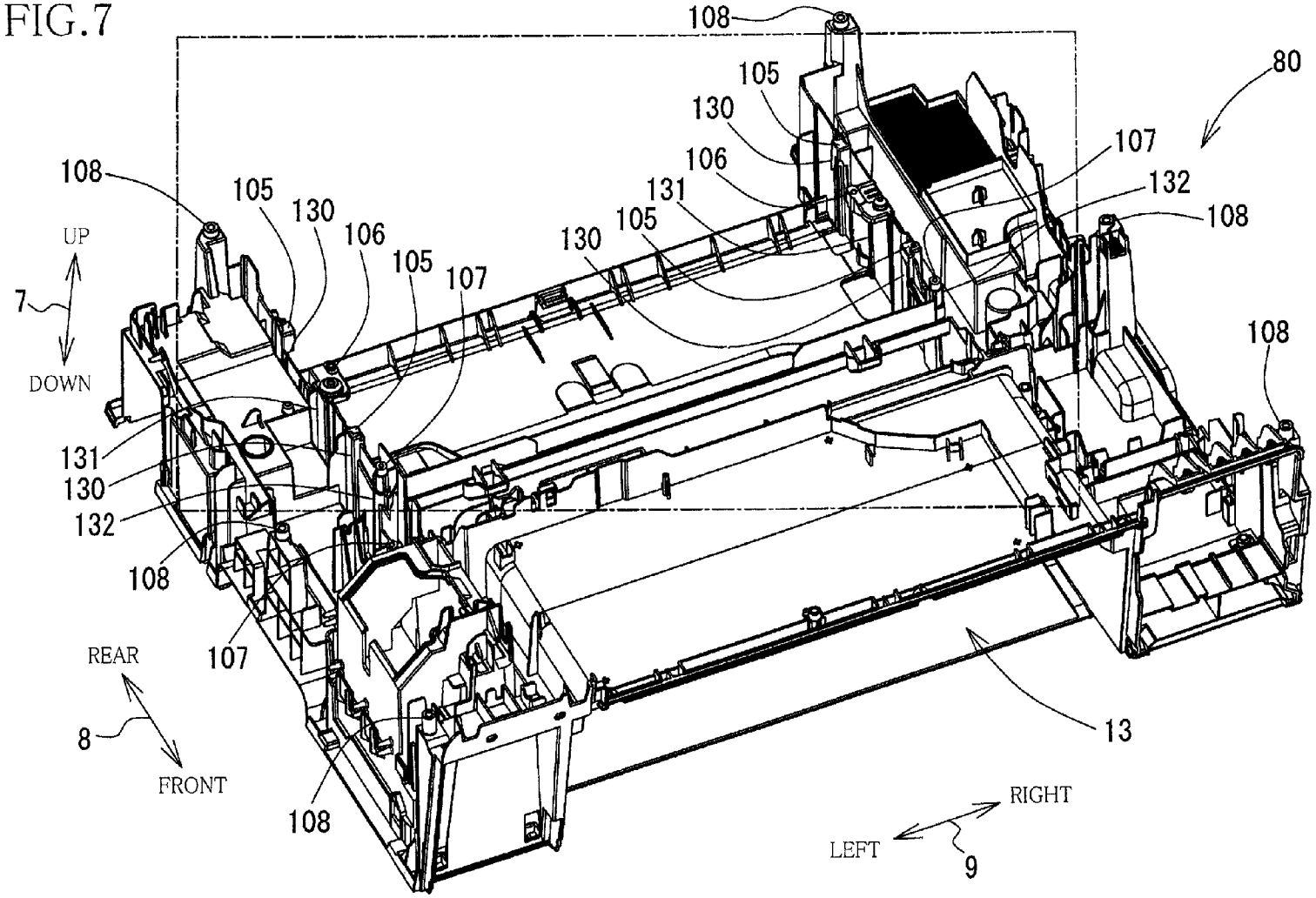
FIG. 7 is a perspective view of the casing 80.

FIG. 7 shows the casing 80 by removing the first frame 76 and the second frame 77 from the components shown in FIG. 3. The casing 80 includes support members 130, support members 131, and support members 132. Each of the support members 130 and the support members 131 is an example of an auxiliary support member. Each of the support members 130 has an upper face functioning as a support face 105 for supporting the first frame 76. Each of the support members 131 has an upper face in which is formed a screw hole 106 for fixing the first frame 76. Each of the support members 132 has an upper face in which is formed a screw hole 107 for fixing the second frame 77. Further, the casing 80 has screw holes 108 formed therein for supporting and fixing the casing 79 of the scanning section 12, for example.

Figure 8:
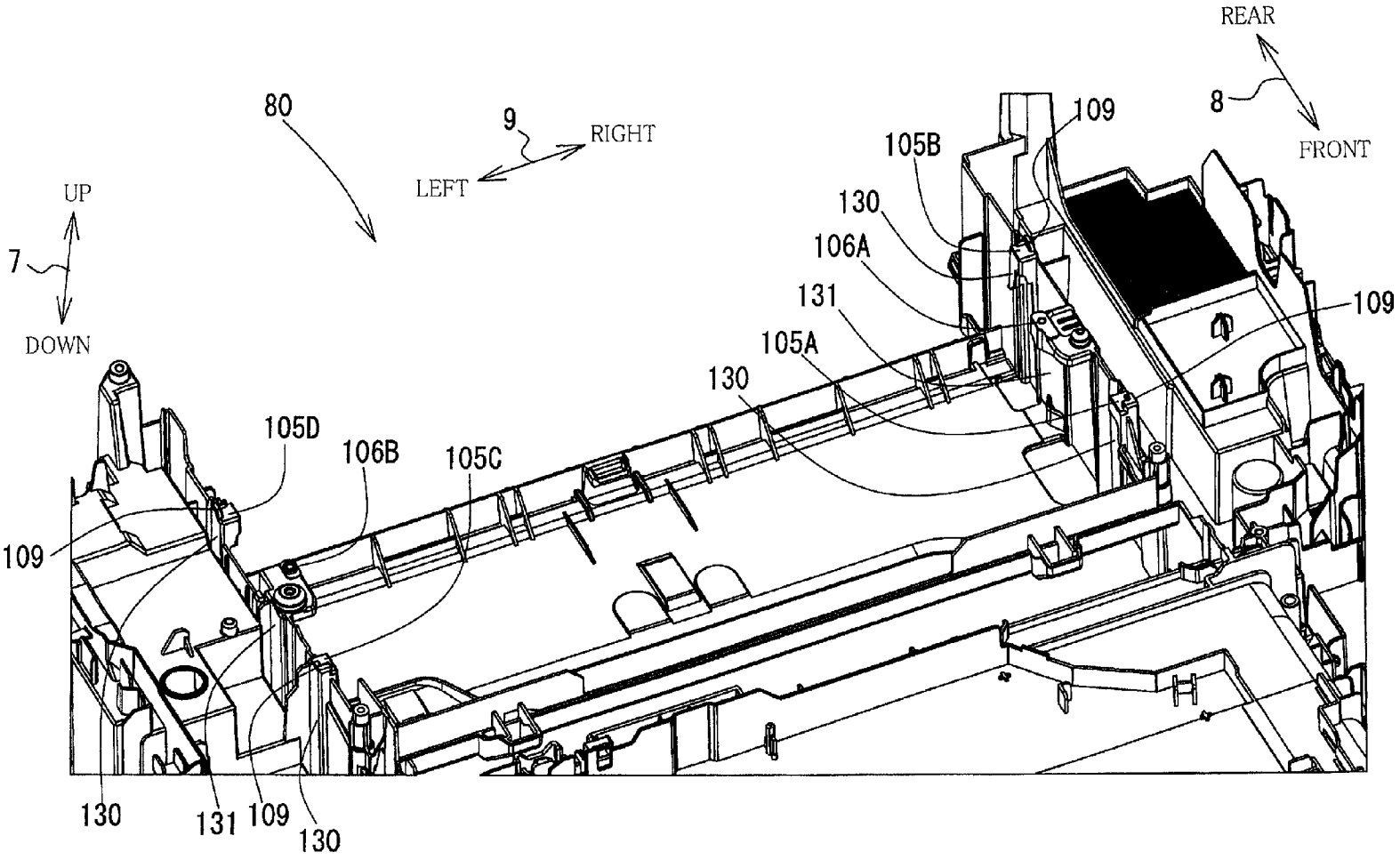
FIG. 8 is an enlarged view partly showing components enclosed by a one-dot chain line in FIG. 7.

As shown in FIG. 8, the casing 80 has support faces 105A, 105B, 105C, 105D. The support face 105A is for supporting a front end portion of a lower face of the first right plate 81 of the first frame 76. The support face 105B is for supporting a rear end of the lower face of the first right plate 81. The support face 105C is for supporting a front end of a lower face of the first left plate 82 of the first frame 76. The support face 105D is for supporting a rear end of the lower face of the first left plate 82. In addition, the casing 80 has screw holes 106A, 106B formed therein. The screw hole 106A is located between the support face 105A and the support face 105B, for fixing a central portion of the lower face of the first right plate 81 of the first frame 76. The screw hole 106B is located between the support face 105C and the support face 105D, for fixing a central portion of the lower face of the first left plate 82 of the first frame 76.

The support face 105A includes a wall portion 109 provided upright so as to extend upward from front and right ends of the support face 105A. The support face 105B includes a wall portion 109 provided upright so as to extend upward from rear and right ends of the support face 105B. The support face 105C includes a wall portion 109 provided upright so as to extend upward from front and left ends of the support face 105C. The support face 105D includes a wall portion 109 provided upright so as to extend upward from rear and left ends of the support face 105D.

Figure 9A:
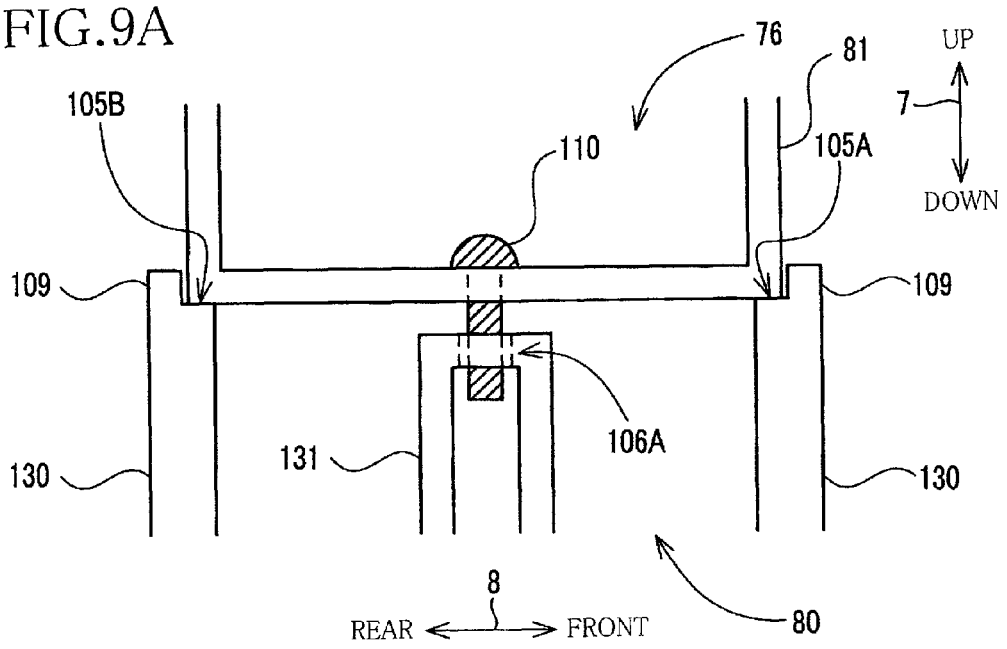
FIG. 9A is an elevational view in vertical cross section schematically showing right support members 130, 131.
Figure 9B:
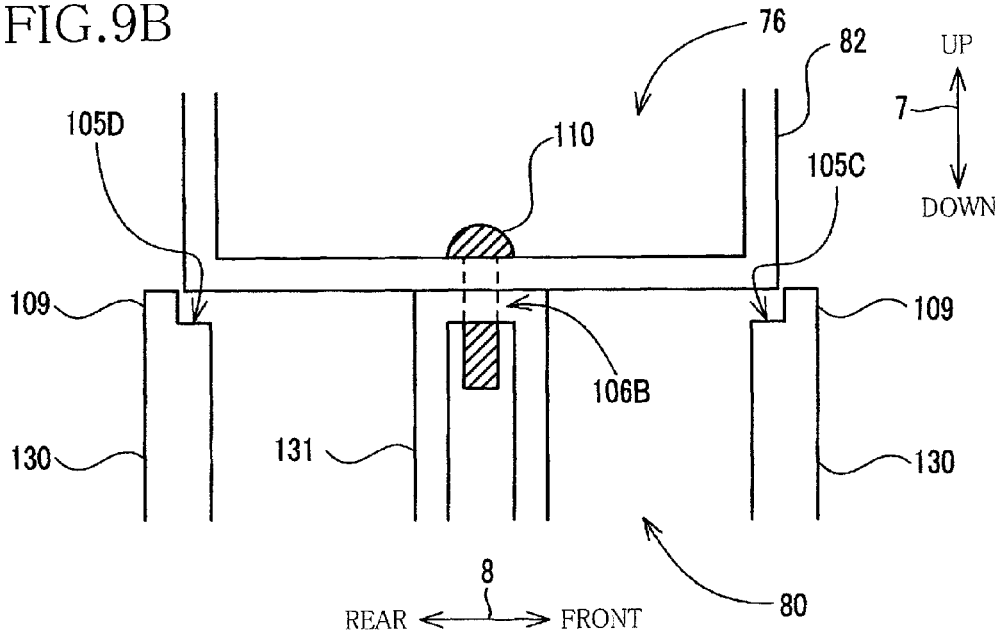
FIG. 9B is an elevational view in vertical cross section schematically showing left support members 130, 131.

As shown in FIGS. 9A and 9B, a position of each of the support faces 105A, 105B in the upward and downward direction 7 is slightly higher than a position of each of the support faces 105C, 105D in the upward and downward direction 7. Further, a position of the screw hole 106A in the upward and downward direction 7 is slightly lower than a position of the screw hole 106B in the upward and downward direction 7. The support faces 105A, 105B and the screw hole 106B are located at the same height, and the support faces 105C, 105D and the screw hole 106A are located at the same height.

Where the first frame 76 has been placed from an upper side of the support faces 105 and the screw holes 106, the first frame 76 is brought into contact with the support faces 105A, 105B and the screw hole 106B. That is, the first frame 76 is supported at its lower portion by the casing 80 at three points. In other words, the first frame 76 is supported by the three portions of the casing 80.

On the other hand, the support faces 105C, 105D and the screw hole 106A are located near a lower portion of the first frame 76 and not brought into contact with the first frame 76. However, where the first frame 76 has been displaced downward from its original position due to a warp, a twist, or the like thereof, the support faces 105C, 105D and the screw hole 106A can support the first frame 76. That is, each of the support faces 105C, 105D and the screw hole 106A is an example of the auxiliary support member.

The first frame 76 and the casing 80 are fixed to each other by a screw 110. Specifically, as shown in FIG. 9B, the screw 110 is inserted through the first left plate 82 from an upper side thereof and tightened to the screw hole 106B of the support member 131 being held in contact with the first left plate 82. As a result, the first left plate 82 and the casing 80 are fixed to each other by the screw 110. However, the screw hole 106A has a diameter larger than that of the screw 110. Accordingly, the screw 110 penetrates or passes through the first right plate 81 from an upper side thereof but is not tightened to the screw hole 106A though the screw 100 is inserted through the screw hole 106A. That is, the first right plate 81 is not fixed to the casing 80 by the screw 110.

In view of the above, the first frame 76 is fixed to the casing 80 at one point (the screw hole 106B) of the three points (the support faces 105C, 105D and the screw hole 106B) supported by the casing 80.

It is noted that a height relationship between the support faces 105 and the screw holes 106 is not limited to the above-described relationship. For example, this MFD 10 may be configured such that the positions of the support faces 105A, 105E in the upward and downward direction 7 are slightly lower than the positions of the support faces 105C, 105D in the upward and downward direction 7, and the position of the screw hole 106A in the upward and downward direction 7 is slightly higher than the position of the screw hole 106B in the upward and downward direction 7.

ADVANTAGES OF EMBODIMENT

In the above-described embodiment, the first frame 76 supports the recording portion 40. On the other hand, the second frame 77 supports the sheet-supply arm 26 on which is mounted the sheet-supply roller 25 for supplying the recording sheet 50 to the first sheet-convey path 16. Further, the first frame 76 and the second frame 77 are not directly connected to each other. As a result, a force of the sheet-supply arm 26 in the upward and downward direction 7, which force is generated by the sheet-supply operation of the sheet-supply arm 26 for supplying the recording sheet 50 acts only on the second frame 77 and does not act on the first frame 76. Accordingly, even where the sheet-supply operation for supplying a certain recording sheet 50 has been performed during the image recording on another recording sheet 50, it is possible to reduce an effect of the sheet-supply operation on the image recording, thereby reducing a deterioration of a quality of the image recorded on the recording sheet 50.

Further, in the above-described embodiment, the first frame 76 is supported by the casing 80 at the three points. In the case of the three-point support, even where a height or heights of at least one of the three points have been changed, a plane including the three points is determined as a flat plane, which never causes a twist or a distortion. Accordingly, even where the casing 80 has been bent or distorted because the casing 80 is placed at an uneven position, and an effect of the bend or distortion has affected the first frame 76, it is possible to prevent the distortion of the first frame 76. It is noted that, as described above, the first frame 76 and the second frame 77 are separate from each other or are not connected to each other, but both of the first frame 76 and the second frame 77 are supported by the casing 80. Thus, the force of the sheet-supply arm 26 in the upward and downward direction 7 may act on the second frame 77 and then disadvantageously act on the first frame 76 via the casing 80. However, in the present embodiment, the first frame 76 is supported by the casing 80 at the three points, thereby making it possible to prevent the first frame 76 from bending by the force exerted from the second frame 77.

Where the first frame 76 is fixed to the casing 80 at the three points and where the height or heights of at least one of the three points have been changed, the first frame 76 may be distorted. However, this MFD 10 is configured such that the first frame 76 is fixed to the casing 80 at the one point and the other two points are merely supported without being fixed. Accordingly, even where the height or heights of at least one of the three points have been changed, it is possible to prevent the distortion of the first frame 76.

The three-point support of the casing 80 for the first frame 76 has less stability than a four-point support, for example. Thus, where the printing section 11 has been swayed violently, for example, the first frame 76 may be inclined greatly. However, in the above-described embodiment, the support members 130, 131 provided near the lower portion of the first frame 76 support the first frame 76 which is to be inclined, thereby preventing the first frame 76 from being inclined greatly.

Further, in the above-described embodiment, the first frame 76 is held in contact at its front portion with the second frame 77. As a result, the second frame 77 is positioned relative to the first frame 76 in the frontward and rearward direction 8 (along the conveying direction). Further, the second frame 77 is not positioned relative to the first frame 76 in the upward and downward direction 7. Accordingly it is possible to prevent that the force of the sheet-supply arm 26 in the upward and downward direction 7 (which force is generated by the sheet-supply operation) acts on the first frame 76.

Further, in the above-described embodiment, the path switch portion 97 is supported by the second frame 77. As a result, it is possible to prevent a force generated by the posture-change of the path switch portion 97 from acting on the first frame 76.

Further, in the above-described embodiment, the sheet-convey arm 74 is supported by the second frame 77. As a result, it is possible to prevent that a force of the sheet-convey arm 74 generated by the operation of the reconvey roller 69 and the pinch roller 70 for nipping the recording sheet 50 conveyed through the second sheet-convey path 90 acts on the first frame 76.

Further, in the above-described embodiment, the first right plate 81 and the first left plate 82 for supporting the convey-roller pair 59 are provided so as to be symmetric in the rightward and leftward direction 9 with respect to the center of the recording sheet 50 in its widthwise direction coinciding with the rightward and leftward direction 9. Accordingly, it is possible to reduce variations in conveying amounts and accuracies in the widthwise direction of the recording sheet 50 when the recording sheet 50 is conveyed.

Further, in the above-described embodiment, the sheet-convey motor 102 is supported by the third frame 78 which does not support the convey-roller pair 59 and the discharge-roller pair 64. Accordingly, it is possible to prevent that an effect of a weight of the sheet-convey motor 102 or a force generated by, e.g., vibration of the sheet-convey motor 102 during its driving affects or acts on the first frame 76. Further, since there is no need for the first frame 76 to support the sheet-convey motor 102, the first frame 76 can be made smaller.

Further, in the above-described embodiment, the third frame 78 is positioned vertically relative to the rotational shafts of the convey-roller pair 59. Accordingly, when the third frame 78 is connected or tightened to the first frame 76, it is possible to prevent a force in the rightward and leftward direction 9 from being transmitted from the third frame 78 to the first frame 76.

What is claimed is:

1. An image recording apparatus comprising:

a casing in which a first conveying path for guiding a recording medium in a conveying direction is provided;

a recording portion configured to record an image on the recording medium guided by the first conveying path;

a tray provided below the recording portion so as to accommodate the recording medium;

a supplying roller configured to supply the recording medium accommodated by the tray to the first conveying path;

a first arm provided above the tray, wherein the supplying roller is provided on a distal end of the first arm;

a first frame supported by the casing and supporting the recording portion; and a second frame supported by the casing, provided separately from the first frame, and supporting the first arm, wherein a position of the second frame in a frontward and rearward direction is determined by a position of the first frame, and wherein a portion of the second frame, in contact with a portion of the first frame, moves in an upward and downward direction with respect to the portion of the first frame in response to a force applied through the first arm in the upward and downward direction while the supplying roller supplies the recording medium.

2. The image recording apparatus according to claim 1, further comprising:

a first roller pair provided on an upstream side of the recording portion in the conveying direction in the first conveying path and configured to convey the recording medium; and a second roller pair provided on a downstream side of the recording portion in the conveying direction in the first conveying path and configured to convey the recording medium.

3. The image recording apparatus according to claim 2, further comprising:

a second conveying path for guiding the recording medium from a position located on a downstream side of the recording portion in the conveying direction in the first conveying path to a position located on an upstream side of the first roller pair in the conveying direction in the first conveying path;

a path switch portion provided on a downstream side of the recording portion in the conveying direction in the first conveying path and configured to switch a path so as to selectively convey the recording medium to one of (a) a path for conveying, in the conveying direction, the recording medium having passed through the recording portion and (b) a path for conveying the recording medium to the second conveying path; and a third roller pair provided on a downstream side of the path switch portion in the conveying direction in the first conveying path so as to be rotatable in a forward direction and in a reverse direction, wherein the third roller pair is rotated in one of the forward and reverse directions to convey the recording medium in the conveying direction and is rotated in the other of the forward and reverse directions to convey the recording medium in a direction opposite to the conveying direction;

wherein the second frame is configured to support the path switch portion and the third roller pair.

4. The image recording apparatus according to claim 3, further comprising:

a nip member disposed above the second conveying path;

a resupply roller provided below the nip member so as to face the nip member and nip the recording medium with the nip member to convey, to the first conveying path, the recording medium having been conveyed to the second conveying path; and a second arm pivotably provided below the second conveying path, wherein the resupply roller is mounted on a distal end of the second arm;

wherein the first frame is configured to support the nip member; and wherein the second frame is configured to support the second arm.

5. The image recording apparatus according to claim 2, wherein the first frame includes:

a support member configured to support the recording medium conveyed through a position just under the recording portion in the first conveying path;

a bottom plate;

a pair of side plates provided so as to extend in the conveying direction and to stand respectively from opposite ends of the bottom plate in a widthwise direction thereof which is a direction perpendicular to the conveying direction and along the support member;

wherein the first roller pair is supported by the pair of side plates; and wherein the pair of side plates are provided so as to be symmetric in the widthwise direction with respect to a center of the recording medium supported by the support member in the widthwise direction.

6. The image recording apparatus according to claim 5, further comprising a third frame provided on at least one of opposite sides of the pair of side plates in the widthwise direction so as to support a driving portion for driving the first roller pair and the second roller pair.

7. The image recording apparatus according to claim 6, wherein the third frame is connected to the first frame along a tangential direction of a concentric circle centered about a rotational shaft of the first roller pair.

8. The image recording apparatus according to claim 1, further comprising a casing configured to support the first frame.

9. The image recording apparatus according to claim 8, wherein the first frame is supported by the casing at three points.

10. The image recording apparatus according to claim 9, wherein the first frame is fixed to the casing at one of the three points.

11. The image recording apparatus according to claim 8, wherein the casing includes at least one auxiliary support member disposed below the first frame so as to support the first frame.

12. The image recording apparatus according to claim 8, wherein the second frame is supported by the casing separately from the first frame.

13. The image recording apparatus according to claim 1, wherein the second frame is positioned relative to the first frame in the conveying direction by contacting the first frame.

14. The image recording apparatus according to claim 13, wherein one of the first frame and the second frame has a recessed portion formed therein, and the other of the first frame and the second frame has a projecting portion insertable into the recessed portion, and wherein a width of the recessed portion in a direction perpendicular to the conveying direction is larger than that of the projecting portion in the direction perpendicular to the conveying direction.

15. An image recording apparatus comprising:

a casing;

a sheet-supply tray;

a recording portion configured to record an image on a recording sheet;

a supplying roller configured to supply the recording sheet from the sheet-supply tray to the recording portion;

a sheet-supply arm provided above the sheet-supply tray, wherein the supplying roller is provided on a distal end of the sheet-supply arm;

a first frame supported by the casing and supporting the recording portion; and a second frame supported by the casing and supporting the sheet-supply arm, wherein a position of the second frame in a frontward and rearward direction is determined by a position of the first frame, and wherein a portion of the second frame, in contact with a portion of the first frame, moves in an upward and downward direction with respect to the portion of the first frame in response to a force applied through the first arm in the upward and downward direction while the supplying roller supplies the recording medium.

* * * * *